US008399395B2

(12) United States Patent
Dreja et al.

(10) Patent No.: US 8,399,395 B2
(45) Date of Patent: Mar. 19, 2013

(54) SOLID FRAGRANCE-EMITTING COMPOSITION

(75) Inventors: Michael Dreja, Neuss (DE); Tatiana Schymitzek, Krefeld (DE); Alexander Ditze, Dusseldorf (DE); Matthias Sunder, Dusseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/415,367

(22) Filed: Mar. 8, 2012

(65) Prior Publication Data

US 2012/0165239 A1 Jun. 28, 2012

Related U.S. Application Data

(63) Continuation of application No. PCT/EP2010/062897, filed on Sep. 2, 2010.

(30) Foreign Application Priority Data

Sep. 9, 2009 (DE) ..... 10 2009 029 292

(51) Int. Cl.
*C11D 17/00* (2006.01)

(52) U.S. Cl. ..... 510/441

(58) Field of Classification Search ..... 510/441
See application file for complete search history.

(56) References Cited

U.S. PATENT DOCUMENTS

| | | | | |
|---|---|---|---|---|
| 6,680,289 | B1 * | 1/2004 | Woo et al. | 510/470 |
| 6,894,019 | B2 * | 5/2005 | Oki et al. | 510/507 |
| 2009/0042766 | A1 * | 2/2009 | Mayer et al. | 510/516 |

FOREIGN PATENT DOCUMENTS

| | | | |
|---|---|---|---|
| WO | WO 01/16265 | A2 | 3/2001 |
| WO | WO 2007/113326 | A1 | 10/2007 |
| WO | WO 2007/115872 | A1 | 10/2007 |

OTHER PUBLICATIONS

PCT International Search Report (PCT/EP2010/062897) dated Jun. 12, 2010.

* cited by examiner

*Primary Examiner* — John Hardee
(74) *Attorney, Agent, or Firm* — Paul A. Pappalardo; Thomas G. Krivulka

(57) ABSTRACT

Herein a solid, scent-imparting composition is disclosed that comprises a water-soluble support, a water-soluble polymer, a malodor-absorbing compound, and a perfume. In a preferred embodiment of the present invention, the water-soluble support is provided as a particulate that is coated with an envelope consisting of the water-soluble polymer, the malodor-absorbing compound, and the perfume. A detergent compound may be included that is at least partly in and/or on the envelope. Washing or cleaning agents comprising the scent-imparting compositions are also described.

10 Claims, No Drawings

SOLID FRAGRANCE-EMITTING COMPOSITION

CROSS-REFERENCE TO RELATED APPLICATIONS

This application is a continuation of PCT Application Serial No. PCT/EP2010/062897, filed on Sep. 2, 2010, which claims priority under 35 U.S.C. §119 to 10 2009 029 292.6 (DE) filed on Sep. 9, 2009. The disclosures PCT/EP2010/062897 and DE 10 2009 029 292.6 are hereby incorporated by reference in their entirety.

FIELD OF THE INVENTION

The present invention relates to a solid, fragrance-imparting composition, and to the use and production thereof. The invention further relates to a washing or cleaning agent that contains the solid, fragrance-imparting composition.

BACKGROUND OF THE INVENTION

Textiles often become hard and lose their softness due to repeated washing. In order to restore softness and flexibility to textiles, and to impart a pleasant scent to them and/or improve their antistatic characteristics, the textiles are often treated with a rinse conditioner in a rinse process that occurs after the actual washing and cleaning process.

Most commercially available rinse conditioners are aqueous formulations that contain a cationic textile-softening compound comprising one or two long-chain alkyl groups in a single molecule as the main active component. Widely used cationic textile-softening compounds include, for example, methyl-N-(2-hydroxyethyl)-N,N-di(tallowacyloxyethyl)ammonium compounds or N,N-dimethyl-N,N-di(tallowacyloxyethyl)ammonium compounds.

Due to the presence of cationic compounds, these conventional rinse conditioner formulations cannot be used simultaneously with the washing or cleaning agents in the actual washing or cleaning process since the cationic softeners interact undesirably with the anionic surfactants typically present. An additional rinsing operation is therefore necessary, but this practice is both time-consuming and energy-intensive.

A further disadvantage is that conventional rinse conditioners do not prevent the deposition of lime residues on the laundry during the rinsing operation. In addition, conventional rinse conditioners often leave unattractive deposits in the dispensing compartment of the washing machine.

Problems may also occur with other textile-conditioning compounds that require separate dispensing and/or a separate rinse cycle.

In many cases, such as for example with towels or functional textiles, using a rinse conditioner is undesirable or even inappropriate. For instance, using conventional rinse conditioners comprising ester quats may impair the breathability of breathable functional textiles. Many consumers do not use any rinse conditioner for towels since the ester quats left in the towels reduce the water absorption capacity of the towels.

Consumers would nevertheless like to impart a pleasant scent to laundered items through washing or rinsing processes.

WO2007/115872 A1 discloses solid, textile-conditioning textile treatment agents which contain a perfume, usable in the main washing cycle of a washing machine.

In addition to transferring scent onto the laundry, there is also interest in controlling malodors. With that in mind, there still remains the need for solid textile treatment agents having perfume capable of controlling malodors.

SUMMARY OF THE INVENTION

It has now been surprisingly found that a solid, scent-imparting composition comprising a water-soluble support, a water-soluble polymer, a malodor-absorbing compound, and a perfume, can scent laundry and absorb malodors when the water-soluble support is provided in a particulate form and comprises, at least in part, an envelope of the water-soluble polymer, the malodor-absorbing compound, and the perfume.

In an embodiment of the present invention, the malodor-absorbing compounds are stably incorporated into the envelope made from a water-soluble polymer. Moreover, unlike in conventional rinse conditioners, virtually no undesirable interactions occur between the malodor-absorbing compound and the perfume. Because of the lack of interaction, essentially no change occurs in the odor impression from the solid, scent-imparting composition, particularly during storage.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

With that said, the present invention in general is a solid, scent-imparting composition comprising: (a) a water-soluble support; (b) a water-soluble polymer; (c) a malodor-absorbing compound; and, (d) a perfume, wherein the water-soluble support is a particulate and further comprises, at least in part, an envelope of the water-soluble polymer, the malodor-absorbing compound, and the perfume.

It is advantageous that the solid, scent-imparting composition be used in the washing cycle of a laundry cleaning method, meaning that the perfume may be conveyed onto the laundry at the very beginning of the washing method, thus developing its full potential. This solid composition is simpler and better to handle than liquid compositions since no drips are left behind on the rim of the bottle or around the bottle closure. The benefit is also seen when a little of the composition is inadvertently spilled during dispensing. Any inadvertent spillage of solid material may be cleaned up more easily and cleanly than spillage of liquid materials.

It is preferred that the water-soluble support herein is selected from the group consisting of inorganic alkali metal salts, organic alkali metal salts, inorganic alkaline earth metal salts, organic alkaline earth metal salts, organic acids, carbohydrates, silicates, urea, and mixtures thereof.

These materials are not only low in cost, but also dissolve rapidly in water. These materials are also odor-neutral or at least low odor.

It is advantageous for a detergent compound to be present at least partly in, and/or on, the envelope.

It is preferred for the detergent compound to be selected from the group consisting of textile-softening compounds, bleaching agents, bleach activators, enzymes, builders, surfactants, silicone oils, anti-redeposition agents, optical brighteners, graying inhibitors, shrinkage prevention agents, anti-crease agents, dye transfer inhibitors, antimicrobial active ingredients, germicides, fungicides, antioxidants, antistatic agents, ironing aids, waterproofing agents, impregnation agents, anti-swelling agents, anti-slip agents, UV absorbers, and mixtures thereof.

The presence of a detergent compound makes it easier to include additional functionality in the solid, scent-imparting composition, such as textile-conditioning characteristics, cleaning characteristics, water-softening characteristics, etc. A further advantage is that incompatible ingredients present in washing agents may be dispensed separately from one another by distributing these ingredients between the washing agent and the solid, scent-imparting composition.

Aggregation or clumping during production and/or storage may be prevented by using pulverulent detergent compounds.

It is particularly preferred for the detergent compound to be a textile-softening compound. The textile-softening compound is preferably selected from polysiloxanes, textile-softening clays, cationic polymers, and mixtures thereof.

The use of polysiloxanes and/or cationic polymers as a detergent compound in the scent-imparting composition is beneficial because these materials exhibit a softening effect and enhance the perfume impression on the laundry. The use of softening clays as a detergent compound in the scent-imparting composition is also beneficial because clays have a water-softening effect and prevent lime deposits on the laundry. In order to achieve optimum performance, it may be preferred for a scent-imparting composition to contain a combination of at least two detergent components. In particular, it is preferable that two textile-softening compounds are employed as the at least two detergent components.

It is preferred for the water-soluble polymer to be selected from the group consisting of polyalkylene glycols, polyethylene terephthalate, polyvinyl alcohols, and mixtures thereof. These water-soluble polymers act as binders.

It is also preferred for the malodor-absorbing compound to be selected from the group consisting of α-cyclodextrin, α-cyclodextrin derivatives, β-cyclodextrin, β-cyclodextrin derivatives, γ-cyclodextrin, γ-cyclodextrin derivatives, δ-cyclodextrin, δ-cyclodextrin derivatives, zinc salts of $C_{16}$-$C_{100}$ fatty acids, and mixtures thereof.

These malodor-absorbing compounds may readily and stably be incorporated into the envelope. In particular, and in theory due to their cyclic structure, cyclodextrins and cyclodextrin derivatives are effective malodor-absorbing compounds.

In one preferred embodiment of the invention, the perfume is contained at least in part in microcapsules.

The use of microcapsules has the advantage that large quantities of perfume are not lost and no longer available for scenting the textiles to be cleaned. This is primarily due to premature vaporization of highly volatile fragrances as early as during merchandizing and storage of the solid, scent-imparting composition.

Due to the use of water-insoluble microcapsules, a long-lasting scent may be imparted to textiles treated with the solid scent-imparting composition. The water-insoluble microcapsules are opened or crushed by external influences, for example by mechanical friction or pressure, such that the perfume is only released as the result of such an action. This mechanical friction or pressure may be through wearing or ironing of the clothing. A further advantage of using encapsulated perfume is that no undesirable interactions occur with the addition ingredients present in the solid, scent-imparting composition, whether during storage or in use in the washing liquor. When using the solid, scent-imparting composition in a washing method, a similar situation applies to the ingredients of a washing agent which are present in the washing liquor.

In order to improve the applications and/or aesthetic characteristics of the scent-imparting composition, the composition may contain additional ingredients preferably selected from the group consisting of dyes, fillers, pearlescent agents, skin-conditioning compounds, bitter substances, and mixtures thereof.

In a preferred embodiment, the scent-imparting composition contains 0.1 to 15 wt. %, preferably 1 to 10 wt. %, and particularly preferably 2 to 7 wt. % of perfume.

In conventional liquid rinse conditioner compositions comprising quaternary ammonium compounds, problems with regard to the stability of the composition occur at a relatively high perfume concentration (>0.4 wt. % perfume in regular rinse conditioner compositions and ≧1 wt. % in concentrated rinse conditioner compositions). One the other hand, larger quantities (≧1 wt. %) of perfume may be incorporated without difficulty into the scent-imparting compositions according to the present invention.

In one particularly preferred embodiment of the invention, the detergent compound is at least partly incorporated into the envelope. In this embodiment, the previously described advantages (reduced to no tendency towards clumping or agglomeration) are most strongly evident.

In an alternative embodiment, the envelope, or the envelope and the unenveloped regions of the water-soluble support, is/are at least partially coated with the detergent compound.

The invention also relates to the use of a solid, scent-imparting composition according to the invention for conditioning textile fabrics.

The invention moreover relates to a method for producing a solid, scent-imparting composition comprising a particulate water-soluble support, a water-soluble polymer, a malodor-absorbing compound, a detergent compound, and a perfume, in which the water-soluble polymer is melted, is mixed in the molten state with the perfume and the malodor-absorbing compound, the resultant melt is applied onto the particulate support in such a manner that the latter is at least partially enveloped, and then the detergent compound is incorporated into the still molten envelope.

The invention also relates to a method for producing a solid, scent-imparting composition comprising a particulate water-soluble support, a water-soluble polymer, a malodor-absorbing compound, a detergent compound and a perfume, in which the water-soluble polymer is melted, is mixed in the molten state with the perfume and the malodor-absorbing compound, the resultant melt is applied onto the particulate support in such a manner that the latter is at least partially enveloped and the at least partially enveloped particulate support is coated with the detergent compound.

The invention additionally relates to a washing or cleaning agent comprising a solid, scent-imparting composition according to the invention.

By introducing the scent-imparting composition according to the invention into a washing or cleaning agent, the consumer is provided with a textile-freshening washing or cleaning agent and no longer needs to use two separate agents (e.g. washing or cleaning agent and textile freshener). Also, a separate rinse cycle is not necessary.

Furthermore there is no need to perfume the washing or cleaning agents and the scent-imparting composition, but instead only the solid, scent-imparting composition. This not only reduces costs but is also beneficial to consumers with sensitive skin and/or allergies.

The invention will be described in greater detail below, inter alia with reference to examples.

The solid scent-imparting composition comprises as essential components: a water-soluble support; a water-soluble polymer; a malodor-absorbing compound; and a perfume.

One essential component of the scent-imparting composition is the water-soluble support. The latter preferably comprises: inorganic alkali metal salts, such as for example sodium chloride, potassium chloride, sodium sulfate, sodium carbonate, potassium sulfate, potassium carbonate, sodium hydrogencarbonate, potassium hydrogencarbonate, sodium tetraborate, or mixtures thereof; organic alkali metal salts, such as for example sodium acetate, potassium acetate, sodium citrate, sodium tartrate, potassium sodium tartrate, or mixtures thereof; inorganic alkaline earth metal salts, such as for example calcium chloride, magnesium sulfate, magnesium chloride, or mixtures thereof; organic alkaline earth metal salts, such as for example calcium lactate, carbohydrates, or mixtures thereof; organic acids, such as for example citric acid, tartaric acid, or mixtures thereof; silicates, such as for example water glass, sodium silicate, potassium silicate, urea, and mixtures thereof. The water-soluble support may in particular comprise a carbohydrate such as selected from the group consisting of dextrose, fructose, galactose, isoglucose, glucose, sucrose, raffinose, isomalt, xylitol, and mixtures thereof. The carbohydrate used is preferably sucrose and may for example comprise candy sugar or nib sugar.

Carbohydrates as the support have the advantage that they do not promote the corrosion of metallic parts in automatic washing machines. When citric acid and/or sodium citrate is/are as the support, there is the advantage that the scent-imparting composition simultaneously includes a builder for reducing water hardness.

The water-soluble support may also contain mixtures of the stated materials.

It is preferred for the water-soluble support to be a particulate, with particle sizes in the range from 0.6 to 30 mm, in particular 0.8 to 7 mm, and particularly preferably 1 to 3 mm. Scent-imparting compositions with particle sizes in the range from 0.8 to 7 mm, and particularly preferably in the range 1 to 3 mm, may be dispensed readily and purposefully as needed.

The solid, scent-imparting composition necessarily contains a malodor-absorbing compound preferably selected from the group consisting of α-cyclodextrin, α-cyclodextrin derivatives, β-cyclodextrin, β-cyclodextrin derivatives, γ-cyclodextrin, γ-cyclodextrin derivatives, δ-cyclodextrin, δ-cyclodextrin derivatives, zinc salts of $C_{16}$-$C_{100}$ fatty acids, and mixtures thereof.

Cyclodextrins are a class of compounds which belong to the cyclic oligosaccharides. They are cyclic degradation products of starch consisting of 6, 7, 8 or 9 α-1,4-glycosidically linked glucose molecules. This gives rise to a toroidal structure with a central cavity. Due to this molecular structure, guest molecules may be enclosed up to saturation level. The absorption ability and capacity depends on the particular size ratio of guest molecule to cavity. Depending on the number of glucose molecules, the cyclodextrins are designated α-cyclodextrin, β-cyclodextrin, γ-cyclodextrin or δ-cyclodextrin. Of the stated cyclodextrins, β-cyclodextrin and/or hydroxypropyl-β-cyclodextrin are preferably used in the solid scent-imparting composition. Suitable cyclodextrins are obtainable for example under the names Cavamax® or Cavasol® (from Wacker Chemie AG).

Alternatively, the zinc salts of $C_{16}$-$C_{100}$ fatty acids may be used. Suitable fatty acids may be unbranched or branched, unsaturated or saturated and/or comprise one or more hydroxyl groups. In particular, zinc salts of abietic acid or zinc salts of saturated or unsaturated hydroxylated fatty acids, preferably zinc salts of ricinoleic acid, may be used as a malodor-absorbing compound. Alternatively, mixtures of zinc ricinoleate with amino acids, in particular with lysine or L-arginine, may also be used. Such zinc salts are for example commercially obtainable under the trade names Tego® Sorb cone 50 or Tego® Sorb A 30 (from Evonik).

A further component of the scent-imparting composition is the water-soluble polymer. Suitable water-soluble polymers preferably have a melting or softening point in the range from 48° C. to 300° C. and may comprise polyalkylene glycols, in particular polyethylene glycols, polyethylene terephthalates and/or polyvinyl alcohols. The water-soluble polymers preferably have a melting or softening point in the range from 48° C. to 120° C.

The melting point is taken to mean the transition from a solid state to a liquid (free-flowing) state. The softening temperature describes the transition from a solid state into a rubbery to high-viscosity melt. The melting and softening temperature may in each case be either a specific temperature or a relatively small range within the range from 48° C. to 300° C.

Suitable polyalkylene glycols in particular comprise polyethylene glycols that, depending on chain length, are liquids or solids. From a molecular weight of 3,000 polyethylene glycols are solid substances and commercially distributed as flakes or powders. Hardness and melting range rise with increasing molecular weight. Preferred polyethylene glycols for the present invention are those with an average molecular weight of between 3,000 and 12,000, more preferably those with an average molecular weight of between 4,000 and 10,000 and particularly preferably those with an average molecular weight of between 6,000 and 8,000.

Polyethylene terephthalate is a species of polyester that is commercially available in crystalline (opaque white) form and amorphous (transparent) form. The melting point of crystalline polyethylene terephthalate is at approx. 260° C. Polyethylene terephthalates, being thermoplastic, may be molded into virtually any desired shape with exposure to heat. Modified polyethylene terephthalates (such as for example blends with other polymers or polyethylene terephthalates with incorporated foreign building blocks) may additionally be used.

Polyvinyl alcohols are commercially available as white-yellowish powders or granules with degrees of polymerization in the range from approx. 500-2,500 (molar masses of approx. 20,000-100,000 g/mol). The degree of hydrolysis amounts to 98-99 or 87-89 mol % and polyvinyl alcohols thus still contain some residual acetyl groups. Manufacturers differentiate polyvinyl alcohols by stating the degree of polymerization of the starting polymer, the degree of hydrolysis and/or the saponification value. Fully saponified polyvinyl alcohols have a softening temperature of 85° C. and a melting point of 228° C. The corresponding values for partially (87-89%) saponified products are distinctly lower at approx. 58° C. (softening point) or 186° C. (melting point).

The water-soluble polymer may also comprise a mixture of the stated materials. It is however preferred for the scent-imparting composition to comprise a polyalkylene glycol and in particular a polyethylene glycol as water-soluble polymer.

A further essential component of the scent-imparting composition is the perfume. Perfume oils or scents which may be used are individual fragrance compounds, for example synthetic products of the ester, ether, aldehyde, ketone, alcohol and hydrocarbon type. Preferably, however, mixtures of various fragrances are used which together produce an attractive scent note. Such perfume oils may also contain natural fragrance mixtures, as are obtainable from plant sources.

Alternatively, or in addition to the fragrances, the perfume may contain "fragrance precursors." A fragrance precursor is a compound which liberates a desired odor and/or fragrance molecule after cleavage of a chemical bond, for example by hydrolysis. A fragrance precursor is typically formed by chemically binding a desired fragrance raw material to a carrier, preferably a slightly or moderately volatile carrier. The combination gives rise to a less volatile and more strongly hydrophobic scent precursor with improved attachment to textiles. The scent is subsequently liberated by breaking the bond between the fragrance raw material and the carrier, for example by a change in pH value (for example in the event of perspiration during wear), atmospheric humidity, heat and/or sunlight during storage, heated drying, or ambient drying on the clothesline.

The scent raw materials for use in scent precursors are typically saturated or unsaturated, volatile compounds which contain an alcohol, an aldehyde and/or a ketone group.

In a preferred embodiment, at least a proportion of the perfume is present in encapsulated form, in particular in microcapsules. These perfume microcapsules are preferably completely located in the envelope of water-soluble polymer. The microcapsules may be water-soluble and/or water-insoluble microcapsules. Melamine-urea-formaldehyde microcapsules, melamine-formaldehyde microcapsules, urea-formaldehyde microcapsules or starch microcapsules may, for example, be used. It is preferred for the perfume to reside completely in the microencapsulated form. Melamine-urea-formaldehyde microcapsules or melamine-formaldehyde microcapsules or urea-formaldehyde microcapsules, which are obtainable from 3M Corporation or BASF, are preferably used. Preferred microcapsules have average diameters in the range from preferably between 5 and 150 μm, and in particular between 10 and 100 μm. The shell enclosing the core or (filled) cavity of the microcapsules has an average thickness in the range between around 0.1 μm and approx. 30 μm, and in particular between around 0.5 μm and approx. 8 μm.

The quantity of perfume in the scent-imparting composition here preferably amounts to between 0.01 and 15 wt. %, particularly preferably between 0.05 and 10 wt. % and very particularly preferably between 0.1 and 7 wt. %.

If the solid, scent-imparting composition contains microcapsules, these are used in the form of a powder, an aqueous preparation, or granules. The quantity of microcapsules in the aqueous preparation preferably amounts to between 39 and 45 wt. %, relative to the entire aqueous preparation. The microcapsules themselves have perfume loading in an amount of 30 to 35 wt. %. Granules containing microcapsules are produced by granulating an aqueous preparation comprising the microcapsules at room temperature in a mixer using a suitable granulation auxiliary, for example silica. The ratio of granulation auxiliary to aqueous preparation here amounts to from 80:20 to 20:80.

When perfume microcapsules are used, the phrase "quantity of perfume" relates not to the quantity of perfume-loaded microcapsules, but instead to the quantity of perfume which is located (in total) in the microcapsules.

In one very preferred embodiment of the invention, the solid, scent-imparting composition furthermore contains at least one detergent compound. A detergent compound is taken herein to mean a compound that either provides a benefit in the actual washing operation, such as for example a water-softening effect, a cleaning effect on the treated textiles, or the contribution of surfactants, bleaching agents, or bleach activators, or that provides a textile-conditioning benefit.

A textile-conditioning effect herein denotes any direct advantageous action of a compound, such as for example a textile-softening effect or crease resistance and any reduction of harmful or negative effects, which may arise on cleaning and/or conditioning and/or wearing, such as for example fading, graying etc.

The textile-conditioning compound may for example comprise textile-softening compounds, enzymes, silicone oils, soil-release polymers, optical brighteners, graying inhibitors, shrinkage prevention agents, anti-crease agents, dye transfer inhibitors, antimicrobial active substances, germicides, fungicides, antioxidants, antistatic agents, ironing aids, waterproofing agents, impregnation agents, anti-swelling agents, anti-slip agents, UV absorbers, and mixtures thereof. Specific examples of these detergent compounds may be found in part in the description of the washing or cleaning agent according to the invention and may also be used in the solid, scent-imparting composition.

In one very preferred embodiment, the detergent compound is a textile-softening compound. This is for example a polysiloxane, textile-softening clay, a cationic polymer, or a mixture of at least two of these textile-softening compounds. The scent-imparting composition preferably also comprises a textile-softening composition.

A preferably usable polysiloxane comprises at least the following structural unit designated (a), (a)

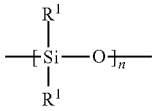

wherein both $R^1$ groups are independently $C_1$-$C_{30}$ alkyl, preferably $C_1$-$C_4$ alkyl, and in particular, methyl or ethyl groups; and n=1 to 5,000, preferably 10 to 2,500, and in particular, 100 to 1,500.

It may be preferred for the polysiloxane additionally to comprise the following structural unit designated (b), (b)

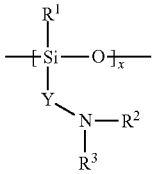

wherein $R^1$ is $C_1$-$C_{30}$ alkyl, preferably $C_1$-$C_4$ alkyl, in particular methyl or ethyl; Y is optionally substituted, linear or branched $C_1$-$C_{20}$ alkylene, preferably —$(CH_2)_m$— with m=1 to 16, preferably 1 to 8, in particular 2 to 4, and specifically 3; $R^2$ and $R^3$ are mutually independently H or an optionally substituted, linear, or branched $C_1$-$C_{30}$ alkyl, preferably $C_1$-$C_{30}$ alkyl substituted with amino groups, particularly preferably —$(CH_2)_b$—$NH_2$ with b=1 to 10, more preferably b=2; and where x is 1 to 5,000, preferably 10 to 2,500, and in particular 100 to 1,500.

If the polysiloxane comprises only the structural unit designed (a) and with $R^1$=methyl, it is a polydimethylsiloxane. Polydimethylsiloxanes are known to be efficient textile-softening compounds.

Suitable polydimethylsiloxanes include DC-200 (from Dow Corning), and Baysilone® M 50, Baysilone® M 100, Baysilone® M 350, Baysilone® M 500, Baysilone® M 1000, Baysilone® M 1500, Baysilone® M 2000, or Baysilone® M 5000 (from GE Bayer Silicones).

It is also preferred for the polysiloxane to contain both of the structural units (a) and (b) above, incorporated into a preferred polysiloxane having the following structure (c),

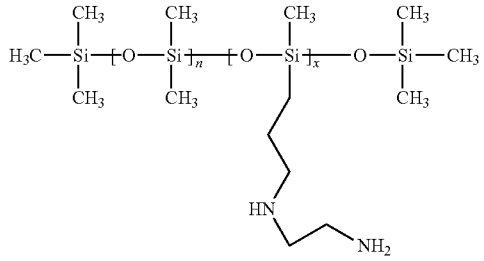

(c)

wherein the sum of n+x is a number between 2 and 10,000.

Exemplary polysiloxanes comprising the general formula (c) are commercially available under the trade names DC 2-8663, DC 2-8035, DC 2-8203, DC 05-7022 and DC 2-8566 (all from Dow Corning). The commercially obtainable products Dow Corning® 7224, Dow Corning® 929 Cationic Emulsion or Formasil 410 (GE Silicones) are likewise suitable according to the invention.

Suitable textile-softening clay is for example smectite clay. Preferred smectite clays include beidellite clays, hectorite clays, laponite clays, montmorillonite clays, nontronite clays, saponite clays, sauconite clays, and mixtures thereof. Montmorillonite clays are the preferred softening clays. Bentonites mainly contain montmorillonites and may serve as a preferred source of the textile-softening clay. Bentonites may be used as powders or crystals.

Suitable bentonites are distributed for example under the names Laundrosil® by Süd-Chemie or under the name Detercal® by Laviosa. It is particularly preferred for the scent-imparting composition to contain a pulverulent bentonite as detergent compound.

Suitable cationic polymers include those described in "CTFA International Cosmetic Ingredient Dictionary", Fourth Edition, J. M. Nikitakis, et al., Editors, published by the Cosmetic, Toiletry, and Fragrance Association, 1991, and designated by the collective term "Polyquatemium". Suitable polyquaternium compounds include for example POLYQUATERNIUM-1 (CAS number: 68518-54-7), POLYQUATERNIUM-2 (CAS number: 63451-27-4), POLYQUATERNIUM-3, POLYQUATERNIUM-4 (CAS number: 92183-41-0), POLYQUATERNIUM-5 (CAS number: 26006-22-4), POLYQUATERNIUM-6 (CAS number: 26062-79-3), POLYQUATERNIUM-7 (CAS number: 26590-05-6), POLYQUATERNIUM-8, POLYQUATERNIUM-9, POLYQUATERNIUM-10 (CAS-numbers: 53568-66-4; 55353-19-0; 54351-50-7; 81859-24-7; 68610-92-4; 81859-24-7), POLYQUATERNIUM-11 (CAS number: 53633-54-8), POLYQUATERNIUM-12 (CAS number: 68877-50-9), POLYQUATERNIUM-13 (CAS number: 68877-47-4), POLYQUATERNIUM-14 (CAS number: 27103-90-8), POLYQUATERNIUM-15 (CAS number: 35429-19-7), POLYQUATERNIUM-16 (CAS number: 95144-24-4), POLYQUATERNIUM-17 (CAS number: 90624-75-2), POLYQUATERNIUM-18, POLYQUATERNIUM-19, POLYQUATERNIUM-20, POLYQUATERNIUM-21 (CAS number: 102523-94-4), POLYQUATERNIUM-22 (CAS number: 53694-17-0), POLYQUATERNIUM-24 (CAS number: 107987-23-5), POLYQUATERNIUM-27, POLYQUATERNIUM-28 (CAS number: 131954-48-8), POLYQUATERNIUM-29, POLYQUATERNIUM-30, POLYQUATERNIUM-31 (CAS number: 136505-02-7), POLYQUATERNIUM-32 (CAS number: 35429-19-7), POLYQUATERNIUM-37 (CAS number: 26161-33-1), POLYQUATERNIUM-44 (CAS number: 150595-70-5), POLYQUATERNIUM-68 (CAS number: 827346-45-2), and mixtures thereof.

It may be preferred for the scent-imparting composition to contain a textile-softening compound and one or more further detergent compound(s).

The quantity of detergent compound in the scent-imparting composition preferably amounts to 0.1 to 15 wt. %, and more preferably between 2 and 12 wt. %.

The scent-imparting composition may optionally contain further ingredients.

The aesthetic appearance of the scent-imparting composition may be improved by dyeing with suitable dyes. Preferred dyes should have elevated storage stability and be insensitive to the other ingredients present and to light, and have no marked substantivity on textile fibers so as not to dye them.

The scent-imparting composition contains filler, such as silica. The quantity of filler may amount to between 0.1 and 10 wt. % and preferably amounts to 1 to 5 wt. %.

The scent-imparting composition may also contain a pearlescent agent to increase gloss. Examples of suitable pearlescent agents are ethylene glycol mono- and distearate (for example Cutina® AGS from Cognis) and PEG-3 distearate.

The scent-imparting composition may furthermore comprise a skin-conditioning compound.

A skin-conditioning compound is taken to mean a compound or a mixture of compounds which, when a textile comes into contact with the washing agent, are deposited on the textile and, when the textile comes into contact with skin, impart an advantage in comparison with a textile which has not been treated with the washing and cleaning agent according to the invention. This advantage may for example involve transfer of the skin-conditioning compound from the textile onto the skin, reduced water transfer from the skin onto the textile or reduced friction on the skin's surface by the textile.

The skin-conditioning compound is preferably hydrophobic, it may be liquid or solid, and it is preferably compatible with the other ingredients of the solid, scent-imparting composition. As such, the skin-conditioning compound is chosen from the group consisting of: (a) waxes such as carnauba, spermaceti, beeswax, lanolin, derivatives thereof, and mixtures thereof; (b) plant extracts, for example plant oils such as avocado oil, olive oil, palm oil, palm kernel oil, rapeseed oil, linseed oil, soy oil, peanut oil, coriander oil, castor oil, poppy seed oil, cocoa oil, coconut oil, pumpkin seed oil, wheat germ oil, sesame oil, sunflower oil, almond oil, macadamia nut oil, apricot kernel oil, hazelnut oil, jojoba oil or canola oil, chamomile, Aloe vera, and mixtures thereof; (c) higher fatty acids such as lauric acid, myristic acid, palmitic acid, stearic acid, behenic acid, oleic acid, linoleic acid, linolenic acid, isostearic acid or polyunsaturated fatty acids, and mixtures thereof; (d) higher fatty alcohols such as lauryl alcohol, cetyl alcohol, stearyl alcohol, oleyl alcohol, behenyl alcohol, 2-hexadecanol, and mixtures thereof; (e) esters such as cetyl octanoate, lauryl lactate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactate, alkyl citrate, alkyl tartrate, and mixtures thereof; (f) hydrocarbons such as paraffins, mineral oils, squalane, squalene, and mixtures thereof; (g) lipids; (h) vitamins such as vitamin A, C or E or vitamin alkyl esters, and mixtures thereof; (i) phospholipids; (j) sunscreen agents such as octyl methoxycinnamate and/or butyl methoxybenzoylmethane; (k) silicone oils such as linear or cyclic polydimethylsiloxanes, amino-, alkyl-, alkylaryl- or aryl-substituted silicone oil; and (l) mixtures thereof.

The quantity of skin-conditioning compound preferably amounts to between 0.01 and 10 wt. %, preferably between 0.1 and 5 wt. % and very particularly preferably between 0.3 and 3 wt. % relative to the solid, scent-imparting composition. It may be that the skin-conditioning compound additionally also has a textile-conditioning effect.

In order to prevent oral intake of the scent-imparting composition by humans, in particular children, or animals, said composition may contain an embittering substance such as Bitrex® (available from Macfarlan Smith).

These further ingredients are preferably introduced into the envelope of the water-soluble polymer.

In order to produce a solid, scent-imparting composition comprising a particulate water-soluble support, a water-soluble polymer, a malodor-absorbing compound and a perfume, the water-soluble polymer is first melted and mixed in the molten state with the perfume and the malodor-absorbing compound. The resultant melt is applied onto the particulate support in such a manner that the latter is at least partially enveloped.

In one particularly preferred embodiment, the solid, scent-imparting composition comprises: a particulate water-soluble support; a water-soluble polymer; a malodorabsorbing compound; a pulverulent; a detergent compound; and, a perfume, wherein the water-soluble support is in a particulate form and at least in part comprises an envelope of the water-soluble polymer, the malodor-absorbing compound, and the perfume, and wherein the pulverulent detergent compound is incorporated into the envelope.

In order to produce such a solid, scent-imparting composition, the water-soluble polymer is firstly melted and mixed in the molten state with the perfume and the malodor-absorbing compound. The resultant melt is applied onto the particulate support in such a manner that the latter is at least partially enveloped, and then the pulverulent, detergent compound is incorporated into the still molten envelope. The pulverulent, detergent compound is here preferably completely incorporated into the envelope. It is, however, alternatively possible for a large proportion of the pulverulent detergent compound to reside on the surface of the envelope.

In an alternative embodiment, the solid, scent-imparting composition comprises a water-soluble support, a water-soluble polymer, a malodor-absorbing compound, a pulverulent detergent compound, and a perfume, in which the water-soluble support is provided in as a particulate, which comprises at least in part an envelope of the water-soluble polymer, the malodor-absorbing compound, and the perfume, and wherein the envelope or the envelope and the unenveloped regions of the water-soluble support is/are at least partially coated with the detergent compound.

In order to produce such a solid, scent-imparting composition, the water-soluble polymer is first melted and mixed in the molten state with the perfume and the malodor-absorbing compound. The resultant melt is applied onto the particulate support in such a manner that the latter is at least partially enveloped and then the envelope or the envelope and the unenveloped regions of the water-soluble support is/are at least partially coated with the pulverulent detergent compound.

It is preferred in both embodiments for the particulate support to be completely enveloped.

It may be preferred for the pulverulent detergent compound to be used in a mixture with further auxiliary compounds. The further auxiliary compounds comprise for example polysaccharides, silicas, zeolites, titanium dioxide, or mixtures thereof.

Suitable polysaccharides comprise in particular cellulose or a cellulose derivative. By addition of polysaccharides, such enveloped, scent-imparting compositions exhibit no tendency to clump or agglomerate either during production or during storage. Such enveloped particles are additionally more flowable. It has furthermore been found that the freshly produced particles may be filled at higher final product temperatures, resulting in shorter production times. In addition, such enveloped scent-imparting compositions retain their crystalline optical properties longer. It is preferred for the detergent compound to be a bentonite and for the polysaccharide to be a cellulose derivative. The cellulose derivative is particularly preferably an N,N,N-trialkylaminohydroxyalkyl-quaternized hydroxyethylcellulose, an N,N,N-trialkylaminohydroxyalkyl-quaternized hydroxypropylcellulose, a carboxymethylcellulose, a methylhydroxypropylcellulose, a hydroxyethylcellulose, an N,N-dialkylaminoalkyl-substituted cellulose derivative or a methylcellulose.

Zeolite, titanium dioxide, and silicas are used on the one hand as "granulation auxiliaries" when enveloping the particulate support with the water-soluble polymer, the perfume, the malodor-absorbing compound and the optional further ingredients used. On the other hand, using zeolites and/or titanium dioxide in particular gives rise to an aesthetically attractive, solid, scent-imparting composition in the form of white crystals.

It may be preferred for the solid, scent-imparting composition, alternatively or in addition to a textile-softening compound as detergent compound, to contain a surfactant, a builder, a dye transfer inhibitor, an enzyme and/or a soil-release polymer as detergent compound. It has surprisingly been found that the presence of citric acid and/or sodium citrate in the envelope stabilizes the dyes. For blue or red colored compositions in particular, color change during storage may be prevented or at least delayed. With the presence of surfactants, cleaning performance during the washing operation may be augmented. The solid, scent-imparting composition may be provided with further functionalities which are advantageous for textile treatment, such as by the presence of a dye transfer inhibitor (for example polyvinylpyrrolidone or copolymers of vinylpyrrolidone and vinylimidazole), an enzyme, and/or a soil-release polymer (for example cellulose ethers or linear, hydrophilic, optionally sulfonated polyethylene terephthalate-polyoxyethylene terephthalate block copolymers).

The scent-imparting composition is particularly suitable for conditioning textile fabrics and to this end is, together with a conventional washing or cleaning agent, brought into contact with the textile fabrics in the (main) washing cycle of a conventional washing and cleaning process.

The scent-imparting composition may be introduced into a washing or cleaning agent.

To this end, a solid washing or cleaning agent is mixed with 1 to 20 wt. %, preferably 5 to 15 wt. %, of the scent-imparting composition according to the invention.

In addition to the scent-imparting composition, the washing or cleaning agents according to the invention may contain at least one surfactant chosen from the group consisting of anionic, nonionic, zwitterionic, amphoteric, and mixtures thereof. From an application perspective, mixtures of anionic and nonionic surfactants are preferred. The total surfactant content of a washing agent is preferably below 40 wt. % and particularly preferably below 35 wt. %, relative to the total washing or cleaning agent.

Preferred nonionic surfactants include the alkoxylated, and in particular the ethoxylated, primary alcohols having 8 to 18 C atoms and on average 1 to 12 mol of ethylene oxide (EO) per mol of alcohol, in which the alcohol residue may be linear or preferably methyl-branched in position 2 or that contain linear and methyl-branched residues in the mixture, as are usually present in oxo alcohol residues. In particular, however, alcohol ethoxylates with linear residues prepared from alcohols of natural origin with 12 to 18 C atoms, for example from coconut, palm, tallow fat or oleyl alcohol, and on average 2 to 8 EO per mol of alcohol are preferred.

Further nonionic surfactants that find use are alkyl glycosides, polyhydroxy fatty acid amides, alkoxylated fatty acid alkyl esters, fatty acid alkanolamides, amine oxides, and mixtures thereof.

The content of nonionic surfactants in the washing or cleaning agents preferably amounts to 5 to 30 wt. %, preferably to 7 to 20 wt. % and in particular to 9 to 15 wt. %, in each case relative to the entire washing or cleaning agent.

The anionic surfactants used may comprise the sulfonate and sulfate type. Surfactants of the sulfonate type that may be used are $C_{9-13}$-alkylbenzene sulfonates, olefin sulfonates, i.e. mixtures of alkene and hydroxyalkane sulfonates and disulfonates. Alkane sulfonates are also suitable. Likewise, the esters of α-sulfofatty acids (ester sulfonates) are also suitable, for example the α-sulfonated methyl esters of hydrogenated coconut, palm kernel or tallow fatty acids. Further suitable anionic surfactants are sulfated fatty acid glycerol esters. Preferred alk(en)yl sulfates are the alkali metal and in particular the sodium salts of the sulfuric acid semiesters of $C_{12}$-$C_{18}$ fatty alcohols. The sulfuric acid monoesters of straight-chain or branched $C_{7-21}$ alcohols ethoxylated with 1 to 6 mol of ethylene oxide are also suitable, such as 2-methyl-branched $C_{9-11}$ alcohols with on average 3.5 mol of ethylene oxide (EO) or $C_{12-18}$ fatty alcohols with 1 to 4 EO.

Further suitable anionic surfactants are also the salts of alkylsulfosuccinic acid and the monoesters and/or diesters of sulfosuccinic acid with alcohols, preferably fatty alcohols and in particular ethoxylated fatty alcohols.

Particularly preferred anionic surfactants are soaps. Saturated and unsaturated fatty acid soaps are in particular suitable, such as the salts of lauric acid, myristic acid, palmitic acid, stearic acid, (hydrogenated) erucic acid and behenic acid and in particular soap mixtures derived from natural fatty acids, for example coconut, palm kernel, olive oil or tallow fatty acids.

The anionic surfactants, including the soaps, may be present in the form of the sodium, potassium or ammonium salts thereof and as soluble salts of organic bases, such as mono-, di- or triethanolamine. The anionic surfactants are preferably present in the form of the sodium or potassium salts thereof, in particular in the form of the sodium salts.

The content of anionic surfactants in the preferred washing or cleaning agents amounts to 2 to 30 wt. %, preferably 4 to 25 wt. % and in particular 5 to 22 wt. %, in each case relative to the total washing or cleaning agent. It may be advantageous if the scent-imparting composition contains cationic polymer and the washing or cleaning agent to contain only nonionic surfactants.

In addition to the scent-imparting composition and the surfactants, the washing or cleaning agents may contain additional ingredients that improve the applications and/or aesthetic characteristics of the washing or cleaning agent. For the purposes of the present invention, preferred washing or cleaning agents may contain one or more substances selected from the group consisting of builders, bleaching agents, bleach activators, enzymes, perfumes, perfume carriers, fluorescent agents, dyes, foam inhibitors, silicone oils, anti-redeposition agents, optical brighteners, graying inhibitors, shrinkage prevention agents, anti-crease agents, dye transfer inhibitors, antimicrobial active substances, germicides, fungicides, antioxidants, preservatives, corrosion inhibitors, antistatic agents, bitter agents, ironing aids, waterproofing agents, impregnation agents, anti-swelling agents, anti-slip agents, neutral filler salts, UV absorbers, and mixtures thereof.

Possible builders, which may be contained in the washing or cleaning agents, may include silicates, aluminum silicates (in particular zeolites), carbonates, salts of organic di- and polycarboxylic acids, and mixtures of these substances.

Organic builders, which may be present in the washing or cleaning agents, comprise polycarboxylate polymers such as polyacrylates and acrylic acid/maleic acid copolymers, polyaspartates and monomeric polycarboxylates such as citrates, gluconates, succinates or malonate, which are preferably used as sodium salts.

Among those compounds acting as bleaching agents which release $H_2O_2$ in water, sodium perborate tetrahydrate and sodium perborate monohydrate are of particular significance. Further usable bleaching agents are, for example, sodium percarbonate, peroxypyrophosphates, citrate perhydrates and $H_2O_2$-releasing per-acidic salts or per-acids, such as perbenzoates, peroxophthalates, diperazelaic acid, phthaloimino per-acid or diperdodecanedioic acid.

Bleach activators may be incorporated into the washing or cleaning agents in order to achieve improved bleaching action when washing at temperatures of 60° C. and below. In addition to, or instead of, conventional bleach activators, it is also possible to incorporate "bleach catalysts" into the washing or cleaning agents.

The washing or cleaning agents may contain enzymes in encapsulated form and/or directly in the washing or cleaning agents. Enzymes which may be considered are in particular those from the classes of hydrolases such as proteases, esterases, lipases or lipolytically active enzymes, amylases, cellulases or other glycosylhydrolases, hemicellulase, cutinases, β-glucanases, oxidases, peroxidases, mannanases, perhydrolases, pectinases and/or laccases and mixtures of the stated enzymes. The enzymes may be adsorbed on support materials in order to protect them from premature decomposition.

In one embodiment, the washing or cleaning agent optionally contains one or more perfume in a quantity of conventionally up to 10 wt. %, preferably of 0.5 to 7 wt. %, in particular of 1 to 3 wt. %. The quantity of perfume used is here also dependent of the nature of the washing or cleaning agent. It is, however, particularly preferred for the perfume to be introduced into the washing or cleaning agent via the scent-imparting composition. It is, however, also possible, for the washing or cleaning agent to contain perfume which is not introduced into the washing or cleaning agent via the scent-imparting composition.

In addition, the solid washing or cleaning agents may also contain neutral filler salts such as sodium sulfate or sodium carbonate.

Specific substances which are suitable for use in the solid, scent-imparting compositions according to the invention and the washing or cleaning agents according to the invention as fluorescent agents, dyes, foam inhibitors, silicone oils, soil-release polymers, optical brighteners, graying inhibitors, shrinkage prevention agents, anti-crease agents, dye transfer inhibitors, antimicrobial active ingredients, germicides, fungicides, antioxidants, preservatives, corrosion inhibitors, antistatic agents, bitter agents, ironing aids, waterproofing agents, impregnation agents, anti-swelling agents, anti-slip agents and UV absorbers are all familiar to a person skilled in the art and do not require a detailed explanation.

The washing or cleaning agents according to the invention may in particular be used for cleaning and conditioning textile fabrics.

The washing or cleaning agents according to the invention are produced by firstly producing the washing or cleaning agent without the solid, scent-imparting composition using known methods, which may for example comprise drying steps, mixing steps, compaction steps, shaping steps and/or the subsequent addition of heat-sensitive ingredients ("post addition"). The resultant product is then mixed with a solid, scent-imparting composition. Further compaction and/or shaping steps may follow in order to produce washing or cleaning agent tablets.

TABLE 1 delineates scent-imparting compositions E1 to E6 according to the invention. All quantities in the table are stated in wt. % of active substance, relative to the total weight of the solid, scent-imparting composition.

TABLE 1

| Ingredients (wt. % active) | E1 | E2 | E3 | E4 | E5 | E6 |
|---|---|---|---|---|---|---|
| Sucrose crystals (1-4 mm) | 67.49 | 67.49 | 67.49 | 67.49 | 66.99 | 67.49 |
| Bentonite (powder) | 10 | 9 | 6 | 9 | 9.5 | 8 |
| Methylhydroxypropyl-cellulose* | — | 1 | — | — | — | — |
| β-Cyclodextrin | 2.5 | 2.5 | 2.5 | 2.5 | 2.5 | 2.5 |
| C12-14 fatty alcohol with 7 EO | — | — | — | — | 0.5 | — |
| Zeolite A | — | — | 4 | — | — | 2 |
| Trisodium citrate* | — | — | — | 1 | — | — |
| Perfume microcapsules** | 5 | 3.5 | 5 | 5 | 5 | — |
| Perfume | — | 1.5 | — | — | — | 5 |
| Silica (d50 = 11.5 μm) | — | — | — | — | 0.5 | — |
| PEG 8000 | 15 | 15 | 15 | 15 | 15 | 15 |
| Dye (blue) | 0.01 | 0.01 | 0.01 | 0.01 | 0.01 | 0.01 |

*pulverulent

**aqueous preparation with 40 wt. % melamine-formaldehyde microcapsules with an outer capsule size D(90) of 20 to 50 μm and a perfume loading of 34%.

The perfume used in the microcapsules and the free perfume were identical.

Scent-imparting compositions E1 to E6 according to the invention were produced by melting the polyethylene glycol with an average molar mass of 8,000 (PEG 8000) and introducing the perfume or perfume capsules, the β-cyclodextrin and the dye and the nonionic surfactant, if present, into the melt. The dyed melt was then applied onto the sucrose crystals and the enveloped sucrose crystals were stirred and powder-finished with the bentonite powder or a mixture of the bentonite powder with zeolite, trisodium citrate and/or silica while the melt of PEG 8000, perfume, β-cyclodextrin and dye had not yet completely solidified.

In the freshly produced state, compositions E1 to E6 all had clear, crystalline optical properties.

The scent-imparting compositions E1 to E6 exhibited very good dissolution behavior on contact with water and, in comparison with water, a softening effect with regard to textile fabrics treated therewith.

Storage stability was determined by storing the solid, scent-imparting compositions E1 to E6 in electronically controlled heated chambers. The storage time was 4 weeks at 40° C. and 12 weeks at 23° C. The compositions were then subjected to visual and olfactory examination.

After storage at 23° C., compositions E1 to E6 still exhibited clear optical properties and no color change. Compositions E1 to E3 and E5 exhibited slight color changes, while the color of composition E4 was unchanged and the color of composition E6 was distinctly changed (weaker).

In contrast with composition E6, compositions E1 to E5 exhibited an unchanged scent profile after storage. Composition E6 exhibited a slight change in scent profile which was, however, only perceived by trained human testers.

Malodor elimination was determined by treating textiles with the solid, scent-imparting compositions E1 to E6 in a conventional domestic washing process (Miele W918, 60 minutes in the main washing cycle at 30° and with a 3.5 kg load of prewashed cotton fabric). After drying in ambient air, the features scent intensity and malodor elimination were blind evaluated by a trained panel (at least 8 people) on a scale from 1 to 7 (no scent/no malodor elimination to intense scent/strong malodor elimination).

The scent intensity of composition E6 was evaluated at 3.3 after 4 weeks' storage at 40° C., while compositions E1 to E5 were evaluated between 5.6 and 6.8. The malodor elimination of composition E6 was evaluated at 3.2 after 4 weeks' storage at 40° C., while compositions E1 to E5 were evaluated between 5.5 and 5.9.

All the compositions E1 to E6 according to the invention thus exhibited a malodor-eliminating action which was distinctly stronger in the compositions with encapsulated perfume.

A washing or cleaning agent according to the invention was produced by mixing a solid, unperfumed washing or cleaning agent with 15 wt. % (relative to the total quantity of finished washing or cleaning agent) of scent-imparting composition E1.

The washing or cleaning agent according to the invention exhibited good cleaning and conditioning characteristics.

No lime deposits on the laundry and/or deposits/residues in the dispensing compartment of the washing machines were observed either when the textile-conditioning compound was used separately or when it was introduced into a washing or cleaning agent.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

We claim:

1. A solid scent-imparting composition comprising:

a. a water-soluble support particulate;

b. a water-soluble polymer;

c. a malodor-absorbing compound; and d. a perfume, wherein said support particulate has at least a partial envelope comprising said water-soluble polymer, said malodor-absorbing compound, and said perfume, and wherein the envelope further comprises a detergent compound at least partially incorporated therein.

2. The composition of claim 1, wherein said support is selected from the group consisting of inorganic alkali metal salts, organic alkali metal salts, inorganic alkaline earth metal salts, organic alkaline earth metal salts, organic acids, carbohydrates, silicates, urea, and mixtures thereof.

3. The composition of claim 1, wherein said detergent compound is selected from the group consisting of textile-softening compounds, bleaching agents, bleach activators, enzymes, builders, surfactants, silicone oils, anti-redeposition agents, optical brighteners, graying inhibitors, shrinkage prevention agents, anti-crease agents, dye transfer inhibitors, antimicrobial active ingredients, germicides, fungicides, antioxidants, antistatic agents, ironing aids, waterproofing agents, impregnation agents, anti-swelling agents, anti-slip agents, UV absorbers, and mixtures thereof.

4. The composition of claim 3, wherein said textile-softening compound is selected from the group consisting of polysiloxanes, textile-softening clays, cationic polymers, and mixtures thereof.

5. The composition of claim 1, wherein said water-soluble polymer is selected from the group consisting of polyethylene glycols, polyethyleneterephthalates, polyvinyl alcohols, and mixtures thereof.

6. The composition of claim 1, wherein said malodor-absorbing compound is selected from the group consisting of α-cyclodextrin, α-cyclodextrin derivatives, β-cyclodextrin, β-cyclodextrin derivatives, γ-cyclodextrin, γ-cyclodextrin derivatives, δ-cyclodextrin, δ-cyclodextrin derivatives, zinc salts of $C_{16}$-$C_{100}$ fatty acids and mixtures thereof.

7. The composition of claim 1, wherein said perfume is at least partly encapsulated.

8. The composition of claim 1 further comprising additional ingredients selected from the group consisting of dyes, fillers, pearlescent agents, skin-conditioning compounds, embittering substances, and mixtures thereof.

9. A method for producing the composition of claim 1, said method comprising the steps of:

a. melting said water-soluble polymer to form a molten polymer;

b. mixing said molten polymer with said perfume and said malodor-absorbing compound to form a resultant melt;

c. applying said melt onto said support particulate such that said melt forms at least a partial envelope; and d. incorporating said detergent compound into the envelope while said envelope is still molten.

10. A washing or cleaning agent further including the composition of claim 1.

* * * * *